US007252556B2

(12) United States Patent
Anbo et al.

(10) Patent No.: US 7,252,556 B2
(45) **Date of Patent: *Aug. 7, 2007**

(54) ELECTRICAL CONNECTOR HAVING LOCKING CLAW

(75) Inventors: Tsugio Anbo, Tokyo (JP); Yoshikazu Tanaka, Tokyo (JP); Tetsu Hirose, Tokyo (JP); Gerard Mulot, Nogent le Roi (FR); Claude Casses, Clevilliers (FR)

(73) Assignees: FCI, Versailles (FR); Mitsubishi Cable Industries, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/560,984

(22) PCT Filed: Jun. 17, 2004

(86) PCT No.: PCT/JP2004/008539

§ 371 (c)(1),
(2), (4) Date: Jun. 21, 2006

(87) PCT Pub. No.: WO2004/114471

PCT Pub. Date: Dec. 29, 2004

(65) Prior Publication Data

US 2006/0281373 A1 Dec. 14, 2006

(30) Foreign Application Priority Data

Jun. 18, 2003 (JP) ..... 2003-173931

(51) Int. Cl.
*H01R 13/514* (2006.01)

(52) U.S. Cl. ..... 439/752; 439/357

(58) Field of Classification Search ..... 439/752, 439/357

See application file for complete search history.

(56) References Cited

U.S. PATENT DOCUMENTS

| | | | | |
|---|---|---|---|---|
| 5,004,436 | A * | 4/1991 | Aoyama | 439/752 |
| 2006/0160433 | A1 * | 7/2006 | Machida et al. | 439/752 |

FOREIGN PATENT DOCUMENTS

| | | |
|---|---|---|
| JP | 56-1119982 | 9/1956 |
| JP | 58-26175 | 2/1958 |
| JP | 8-296613 | 11/1996 |
| JP | 8-335473 | 12/1996 |
| JP | 2002-334739 | 11/2002 |
| JP | 2003-257533 | 9/2003 |

* cited by examiner

*Primary Examiner*—Tho D. Ta
(74) *Attorney, Agent, or Firm*—Harrington & Smith, PC

(57) ABSTRACT

A front end 7 of a locking arm 4 provided on a rear holder 1 is inserted into a hole portion 25 formed in a main housing 21, and the locking arm 4 is supported like as a bridge. The main housing 21 is inserted into a hood portion 44 of a cooperating housing 41 and connecting terminals are connected to each other to establish the electrical connection. A locking claw 5 formed on the locking arm 4 is once resiliently moved downward to pass through a locking claw 43 of the cooperating housing 41 and is then restored into an original posture to engage the locking claw 5 with the locking claw 43. Once the main housing 21 is engaged with the cooperating housing 41, these housings could not be released accidentally.

6 Claims, 8 Drawing Sheets

ELECTRICAL CONNECTOR HAVING LOCKING CLAW

TECHNICAL FIELD

The present invention relates to an electrical connector including a pair of housings and a pair of connecting terminals installed within the housings, said housings being detachably coupled with each other to establish an electrical connection.

TECHNICAL BACKGROUND

In order to retain accommodated connecting terminals within a housing, locking lances are usually provided within the housing. In order to further improve the above mentioned locking of the connecting terminals within the housing, it has been proposed to insert a rear holder into a rear portion of the housing. The rear holder serves to prevent the connecting terminals from being removed. It has been further proposed to provide locking lances within the rear holder.

In general, a pair of housings each having a connecting terminals installed therein are coupled with each other, and the coupled condition is maintained by means locking mechanisms provided on the housings. Usually the rear holder does not have any roll in this coupling, and therefore the rear holder could not be locked sufficiently. Moreover, when a locking arm is provided on the housing, a size of the housing is liable to be large and a height of the housing is increased.

The applicant of the instant application has proposed, in Japanese Patent Applications Nos. 2002-57638 and 2003-3995, a locking mechanism in which a locking arm is provided on a rear holder coupled with one of a pair of housings and this housing is locked with the other housing by means of the locking arm. Then, the housing with which the rear holder is coupled is sandwiched between the rear holder and the other housing, and the assembly is hardly decomposed accidentally.

DISCLOSURE OF THE INVENTION

Problems to be Solved by the Invention

In the above mentioned electrical connector, when the rear holder is coupled with the housing, but the housings are not clamped with each other, the locking arm extends outwardly from the rear holder and electric wires are liable to intertwine with the locking arm and the locking arm might be bent.

The present invention has for its object to provide an electrical connector, in which the above mentioned problems can be solved and a locking arm provided on a rear holder is arranged as a bridging member and a pair of housings are coupled with each other by locking the rear holder with the housing by means of the locking arm.

MEANS FOR SOLVING THE PROBLEMS

In order to attain the above mentioned object, according to the invention, an electrical connector comprising a main housing and cooperating housing each having connecting terminals installed therein, said connecting terminals being connected to each other by engaging these housings with each other, characterized in that a rear holder is coupled with a rear portion of the main housing to prevent the connecting terminals installed therein from being removed backwardly, that a locking arm having a resiliency is provided on the rear holder such that a free end of said locking arm extends forwardly, said locking arm being locked with a locking portion of the cooperating housing and said free end of the locking arm is inserted into a part of said main housing, and that a locking claw is provided on the locking arm at a middle portion thereof such that the locking claw is engaged with the locking portion of the cooperating housing.

MERITS OF THE INVENTION

In the electrical connector according to the invention, the free end of the locking arm provided on the rear holder is inserted into a part of the main housing and the locking claw provided at the middle portion of the locking arm is engaged with the locking portion of the cooperating housing to lock the main housing and cooperating housing with each other, and therefore the free end of the locking arm does no more extend outwardly, and as long as the locking condition is released, the housings are not decomposed and furthermore the rear holder is not accidentally removed from the main housing. In this manner, a much more positive coupling can be attained.

EXPLANATION OF REFERENCE NUMERALS

Figure 1:
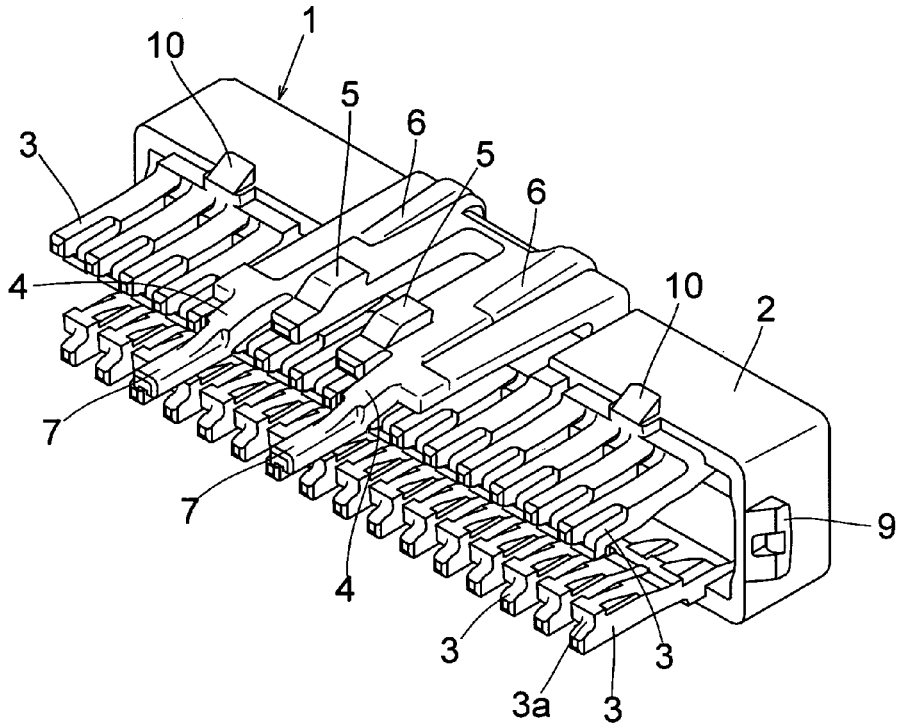
FIG. 1 is a perspective view showing a rear holder of an embodiment of the electrical connector according to the invention.

1 rear holder
2 main body of rear holder
3 locking lance
4 locking arm
5 locking claw
6, 6' projecting portion
7 front end
21 main housing

22 connecting terminal accommodating holes
24 opening
25 hole
28 lock-releasing push portion
32, 42 connecting terminal
41 cooperating housing

BEST MODE OF THE INVENTION

Figure 2:
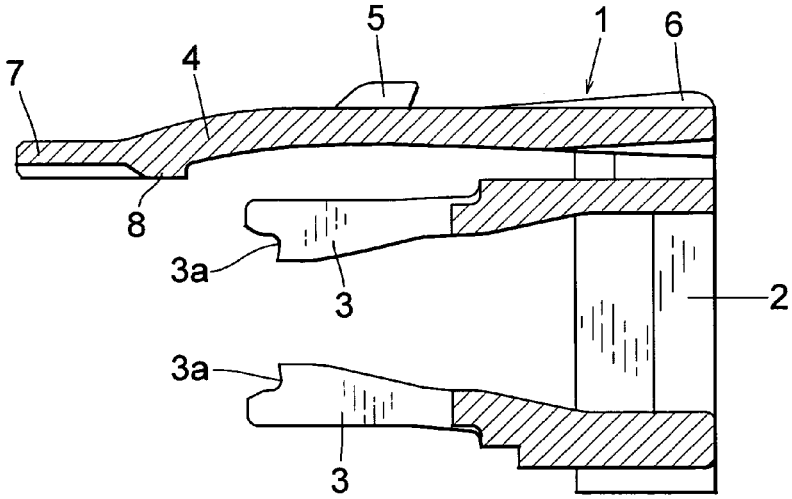
FIG. 2 is a cross section view of the rear holder.

FIGS. 1 and 2 are a perspective view and a cross sectional view, respectively showing a rear holder 1 of an embodiment of the electrical connector according to the invention. The rear holder 1 includes a frame-like rear holder main body 2, and at one end of the rear holder main body there are formed resilient locking lances 3 having claws 3*a* in such a manner that two columns each having 16 locking lances are arranged symmetrically viewed in a vertical direction. These locking lancers 3 are inserted into terminal accommodating holes formed in a main housing.

At a middle of an upper wall of the rear holder main body 2, there are formed two locking arms 4 such that rear ends of these locking arms are fixed to the rear holder main body 2 and free ends of the locking arms extend forwardly. The locking arms 4 have resiliency and are slightly curved. At a middle portion of each of the locking arms 4 there is formed a locking claw 5 which is to be engaged with a cooperating housing. On an upper surface of the locking arm 4 there is formed a rib-like projecting portion 6 which extends from a middle portion of the locking arm to the rear end. Furthermore, a front end 7 of the locking arm 4 is formed to be inserted into a part of the main housing, and a projection 8 is formed on a lower surface of the front end 7.

On side walls of the rear holder main body 2 there are formed locking claws 10 for finally engaging the rear holder with the main housing, and on upper and lower surfaces of the rear holder main body 2 there are formed four engaging claws 10 for temporally engaging the rear holder with the main housing.

Figure 3:
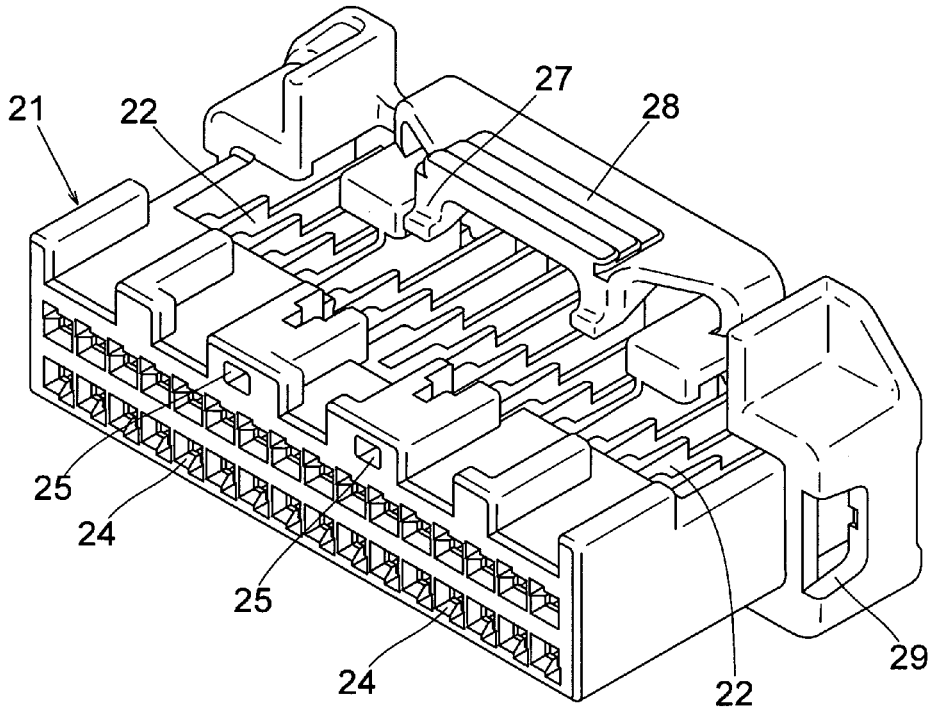
FIG. 3 is a perspective view depicting a main housing.
Figure 4:
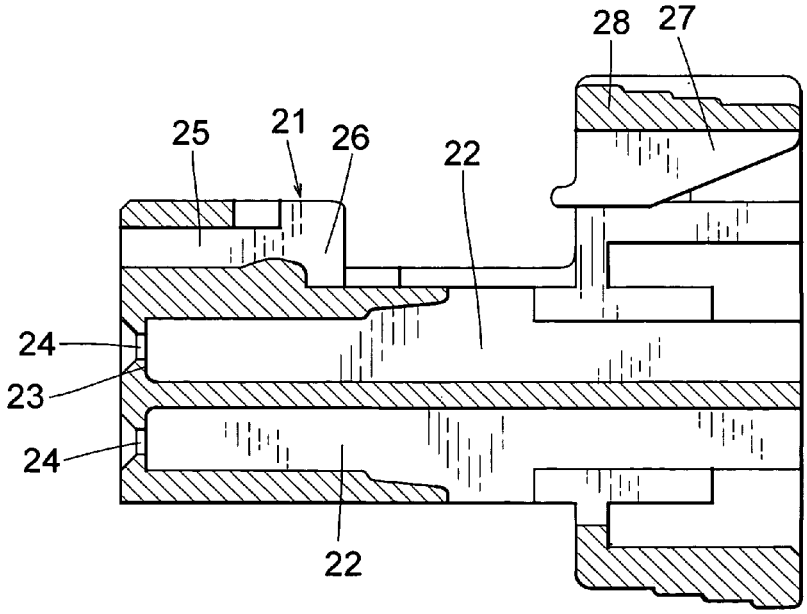
FIG. 4 is a cross sectional view of the main housing.

FIG. 3 is a perspective view showing a main housing 21 and FIG. 4 is a cross sectional view of the main housing. Within the main housing 21 there are formed terminal accommodating holes 22 at positions corresponding to the engaging lances 3 of the rear holder 1 in such a manner that each of two columns of holes includes 16 holes for accommodating the connecting terminals. In front walls 23 of the terminal accommodating holes 22 there are formed openings 24, through which flat blade-like tips of corresponding connecting terminals are inserted into the terminal accommodating holes 22. At a front end on an upper surface of the main housing 21 there are formed hole portions 25 into which the front portions 7 of the locking arms 4 of the rear holder 1 are to be inserted, and at openings of the hole portions 25 there are provided projections 26 which correspond to the projections 8 of the locking arms 4.

At an opening of the main housing 21 into which the rear holder 1 is to be inserted, there is formed a lock-releasing push portion 28 having a contact portion 27 for releasing an engagement explained later by pushing the projecting portions 6 of the rear holder 1. The lock-releasing push portion 28 is formed in a shape of a bridge to have a resiliency. On both side walls of the main housing 21 there are formed elongated holes 29 corresponding to the locking claws 9 of the rear holder 1. Furthermore, in the main housing 21, there are formed temporally engaging recesses cooperating with the temporally engaging claws 10 of the rear holder 1, but these recesses are not shown in the drawings.

Figure 5:
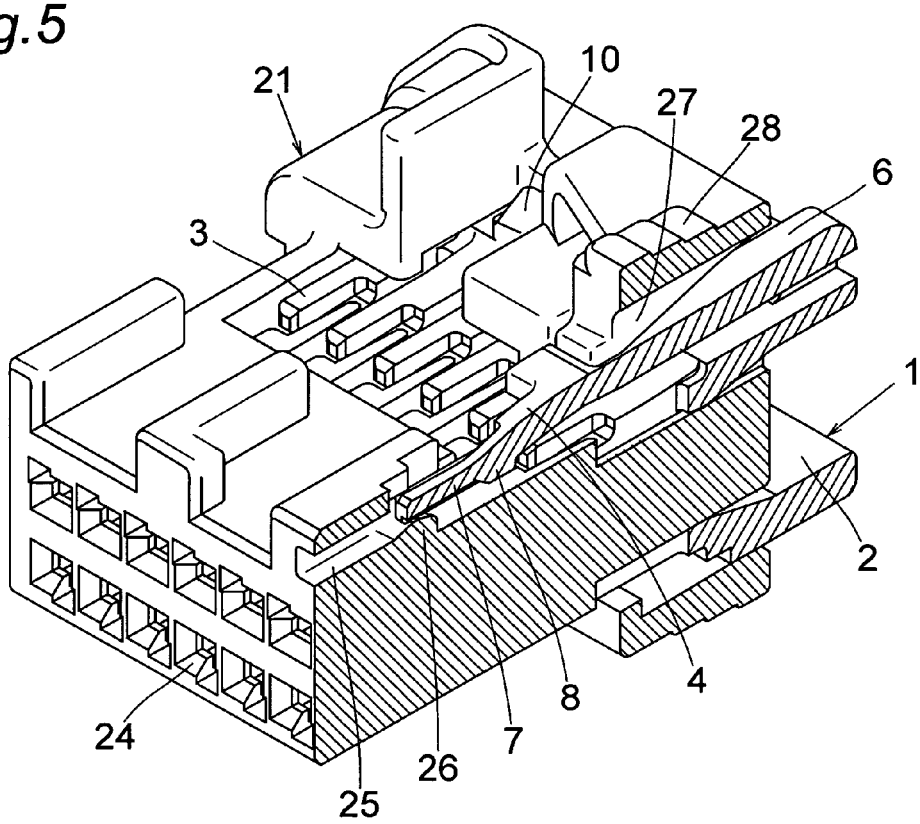
FIG. 5 is a perspective view showing a condition in which the rear holder is temporally engaged with the main housing, while a portion is cut away.
Figure 6:
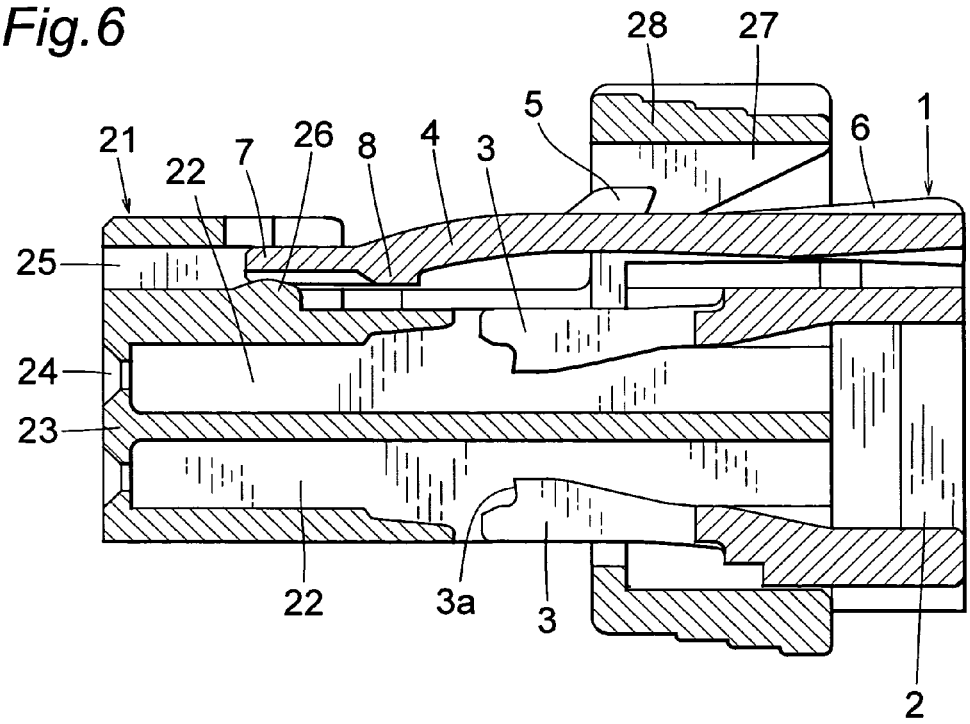
FIG. 6 is a cross sectional view of FIG. 5.

FIG. 5 is a perspective view showing an assembly of the rear holder 1 and main housing 21 in a temporally engaged condition, while apart of the assembly is cut out, and FIG. 6 is across sectional view of the assembly. The rear holder 1 is inserted into the main housing 21 from a rear side and is engaged with the main housing 21 at a middle of the main housing in a temporally engaged condition. In this temporally engaged condition, the temporally engaging claws 10 of the rear holder 1 are engaged with the temporally engaging recesses of the main housing 21, and therefore the rear holder 1 is stably coupled with the main housing 21. The locking lances 3 of the rear holder 1 are positioned in front of the openings of the terminal accommodating holes 22 of the main housing 21 and the front end 7 of the locking arms 4 are inserted into the openings of the hole portions 25.

Figure 7:
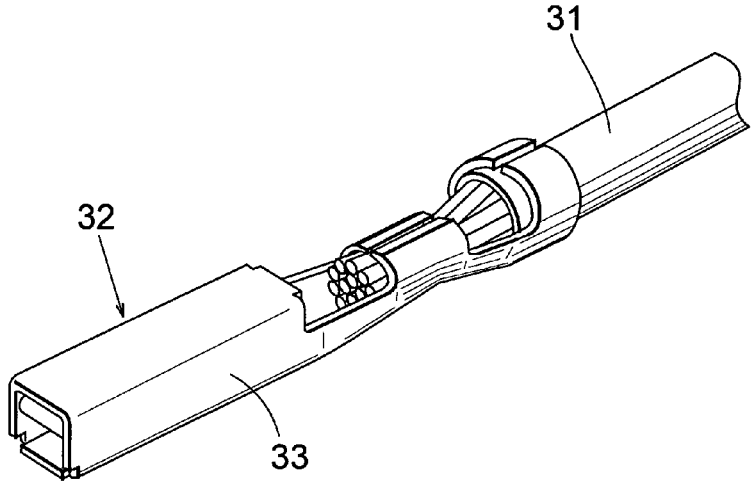
FIG. 7 is a perspective view showing a connecting terminal to which an electrical wire is connected.
Figure 8:
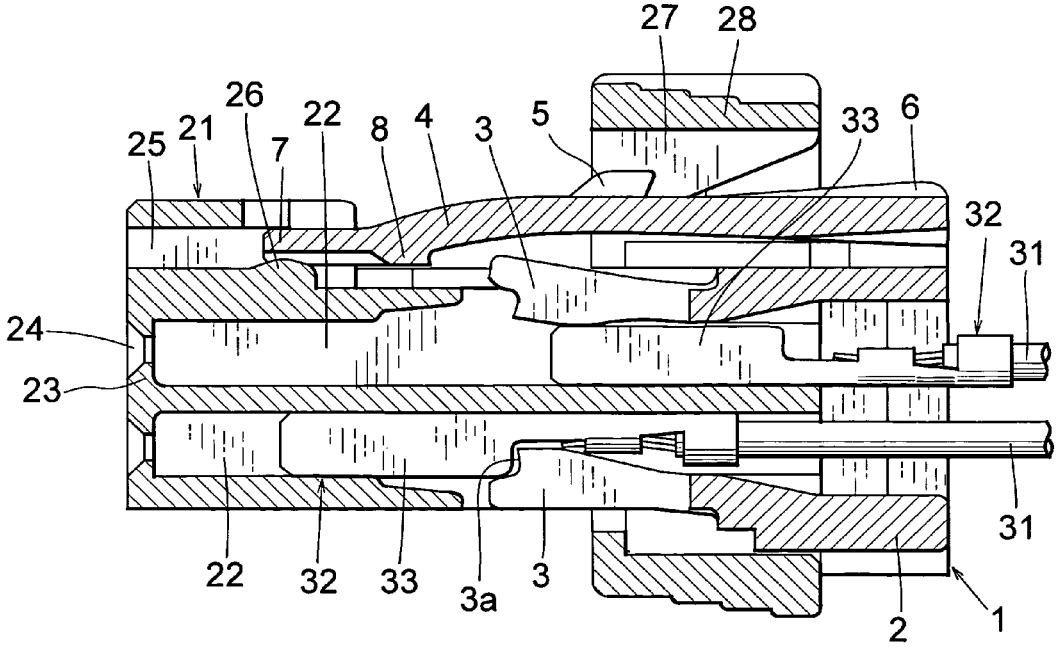
FIG. 8 is a cross sectional view depicting the temporally engaging condition while the connecting terminals are installed within the housing.

When a female type connecting terminal 32 having an electric wire 31 connected there to as illustrated in FIG. 7 is inserted into a terminal accommodating hole 22 of the main housing 21 through the rear holder main body 2, a connecting portion 33 positioned at a front end of the connecting terminal 32 and having a movable contact strip pushes a locking lance 3 as shown in an upper column of FIG. 8, and then is further inserted inwardly. In this condition, a rear edge of the connecting terminal 33 is locked by a claw portion 3*a* of the locking lance 3.

Figure 9:
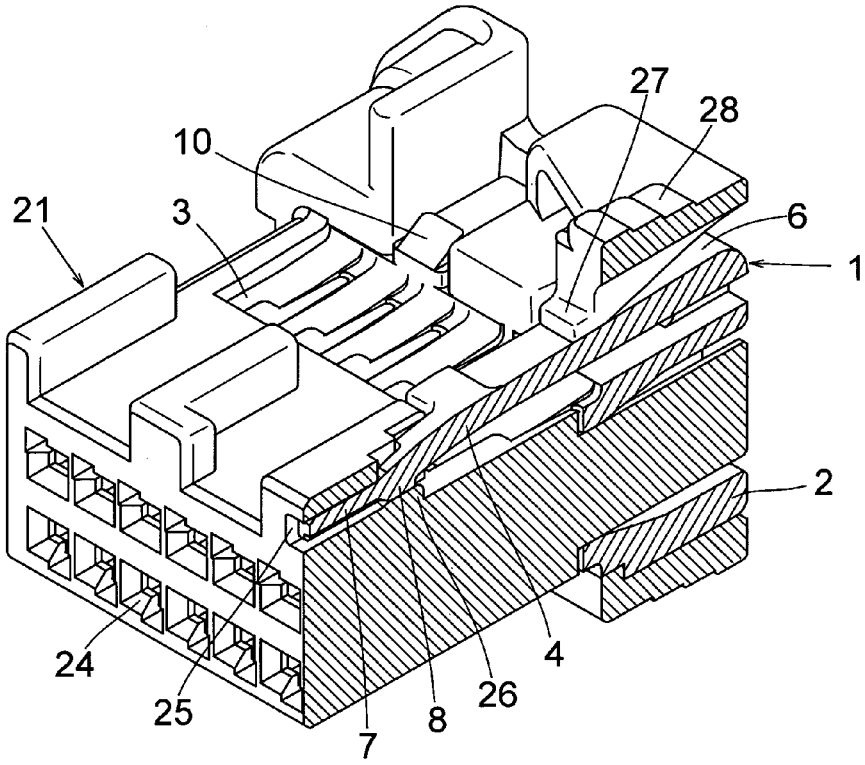
FIG. 9 is a perspective view showing a condition in which the rear holder is finally engaged with the main housing.
Figure 10:
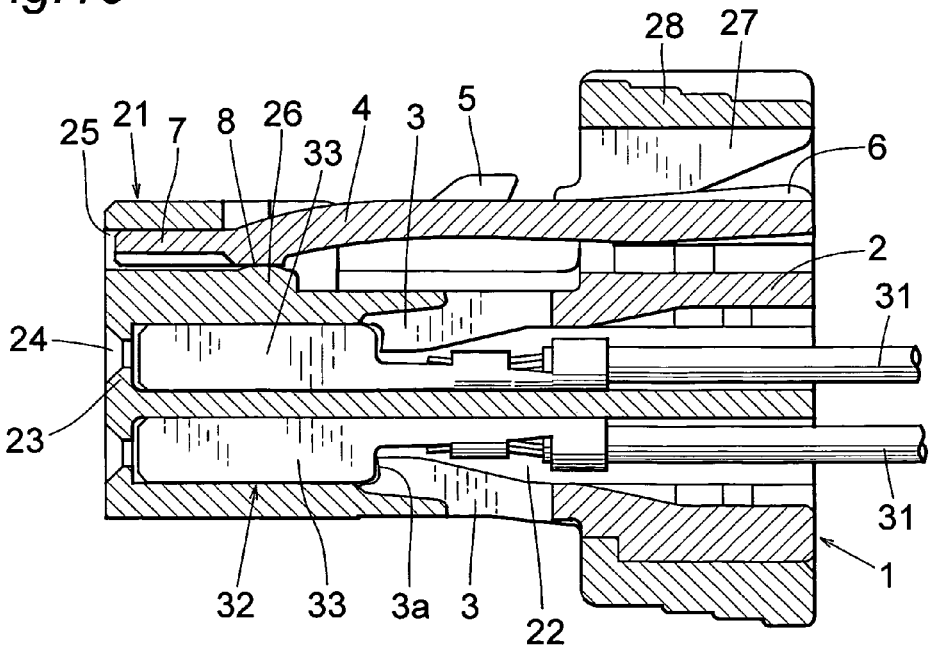
FIG. 10 is a cross sectional view of FIG. 9.

FIGS. 9 and 10 are perspective and cross-sectional views, respectively showing the finally engaged condition. After inserting all connecting terminals into the terminal accommodating holes 22 while the rear holder 1 is in the temporally engaged condition, the rear holder 1 is further pushed into the main housing 21 into the finally engaged condition, in which the rear edges of the connecting portions 33 of the connecting terminals 32 is pushed by the locking lances 3 and are inserted into the front ends of the terminal connecting holes 22 and the connecting terminals 33 are prevented from being further extended forwardly by means of the front walls 23.

The locking arm 4 is inserted into the hole portions 25 of the main housing 21 and is prevented from moving upward, and the projection 8 is engaged with the projection 26 to fix the front end 7 firmly. In this condition, the locking arm 4 is biased to move upward. During the movement of the rear holder 21 into the finally engaged position, a relatively large force is required to insert the rear holder 21 due to the engagement of the projection 8 with the projection 26, and therefore a user can know that the rear holder 1 has been properly inserted into the finally engaged position.

Figure 11:
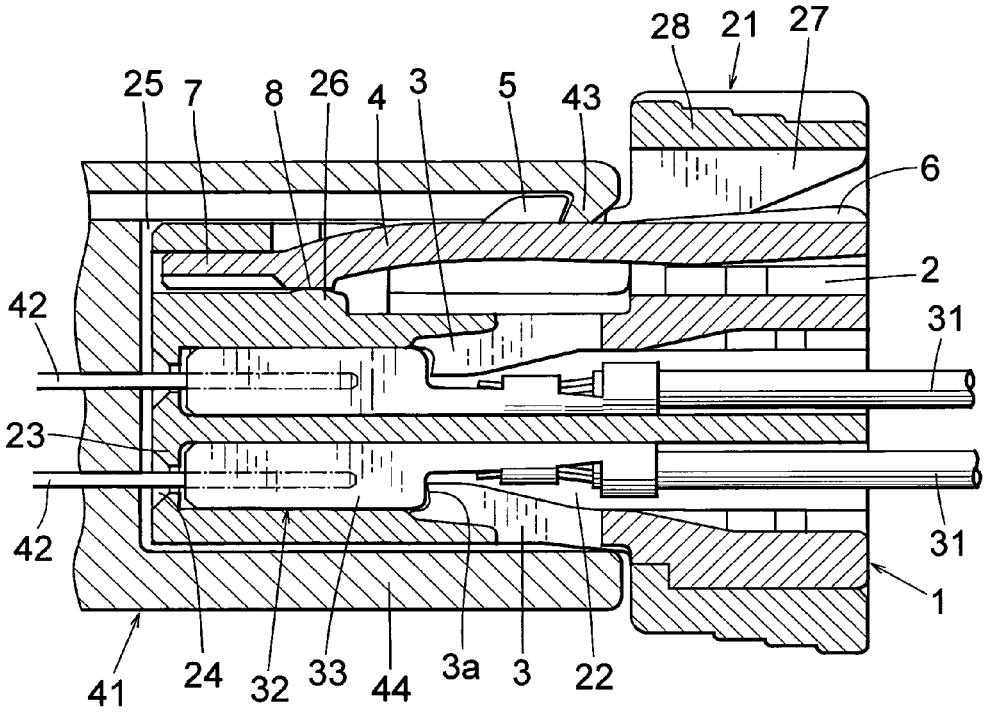
FIG. 11 is a cross sectional view illustrating a condition in which the main housing is engaged with the cooperating housing.

FIG. 11 is a cross sectional view depicting the condition in which the main housing 21 has been engaged with a cooperating housing 41. The cooperating housing 41 has male type connecting terminals 42 installed therein, and these male type connecting terminals 42 have been inserted into corresponding female type connecting terminals 32. The cooperating housing 41 includes locking claws 43 which are engaged with the locking claws 5 of the locking arms 4 of the rear holder 1.

The main housing 21 is inserted into a hood portion 44 of the cooperating housing 41, and the connecting terminals 32 and 42 are engaged with each other to establish the electrical connection. Upon engaging the main housing and cooperating housing with each other, the locking claw 5 of the locking arm 4 is resiliently moved downward, and after passing through the locking claw 43 of the cooperating housing 41, the locking claw 5 is returned into the original position to engage the locking claws 5 and 43 with each other. In this manner, the main housing 21 and cooperating housing 41 are firmly locked and this locking condition is not released accidentally.

In order to release the locking condition, the lock-releasing push portion 28 provided on the main housing 21 is pushed downward with fingers. Then, the locking arm 4 is moved downward by means of the contact portion 27 of the main housing 21 and the projecting portion 6 of the locking arm 4 to release the engagement of the locking claws 5 and 43. Then, the main housing 21 is pulled out of the cooperating housing 41.

Figure 12:
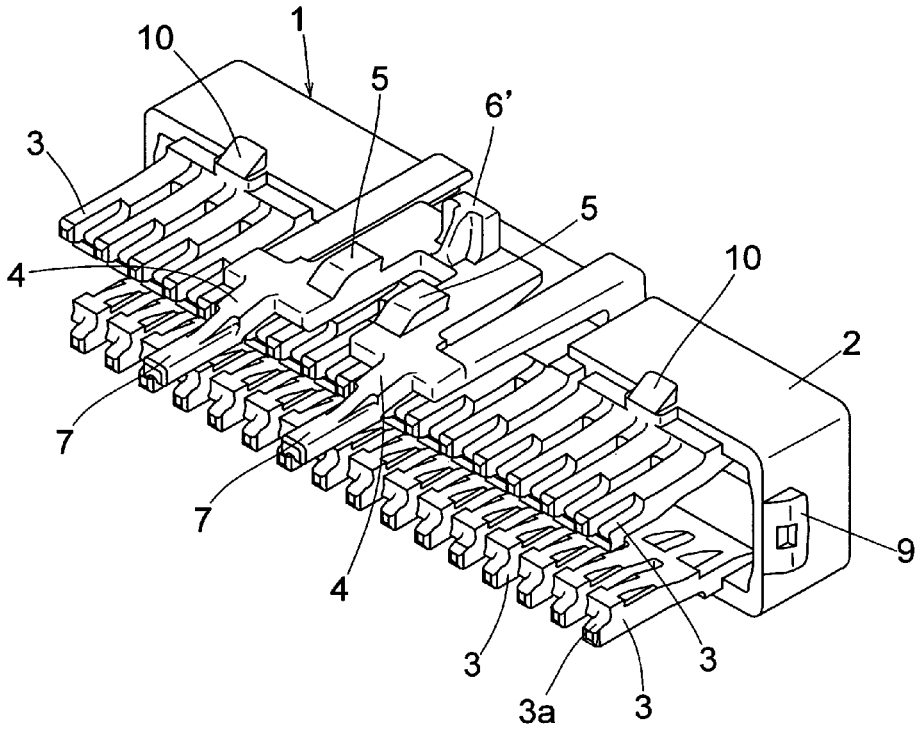
FIG. 12 is a perspective view showing another embodiment of the rear holder.

FIG. 12 is a perspective view showing another embodiment of the rear holder. In this embodiment, a projecting portion 6' is provided at a free end of the locking arm 4 such that the projecting portion 6' extends upward. In the finally engaged condition, a top end of the projecting portion 6' is brought into contact with a rear surface of the lock-releasing push portion 28 of the main housing 21.

Figure 13:
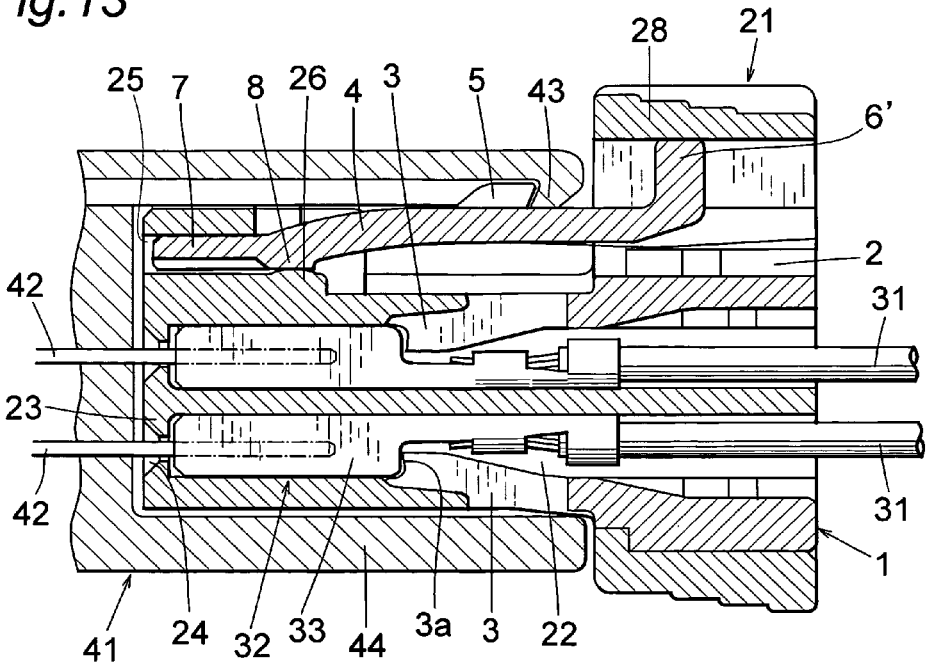
FIG. 13 is a cross sectional view depicting a condition in which the main housing has been engaged with the cooperating housing.

In the present embodiment, in the finally engaged condition shown in FIG. 13, the top end of the projecting portion 6' is directly brought into contact with the lower surface of the lock-releasing push portion 28, and therefore when the lock-releasing push portion 28 is pushed downward, the locking claw 5 of the locking arm 4 is moved downward and the engagement of the housings can be released.

Figure 14:
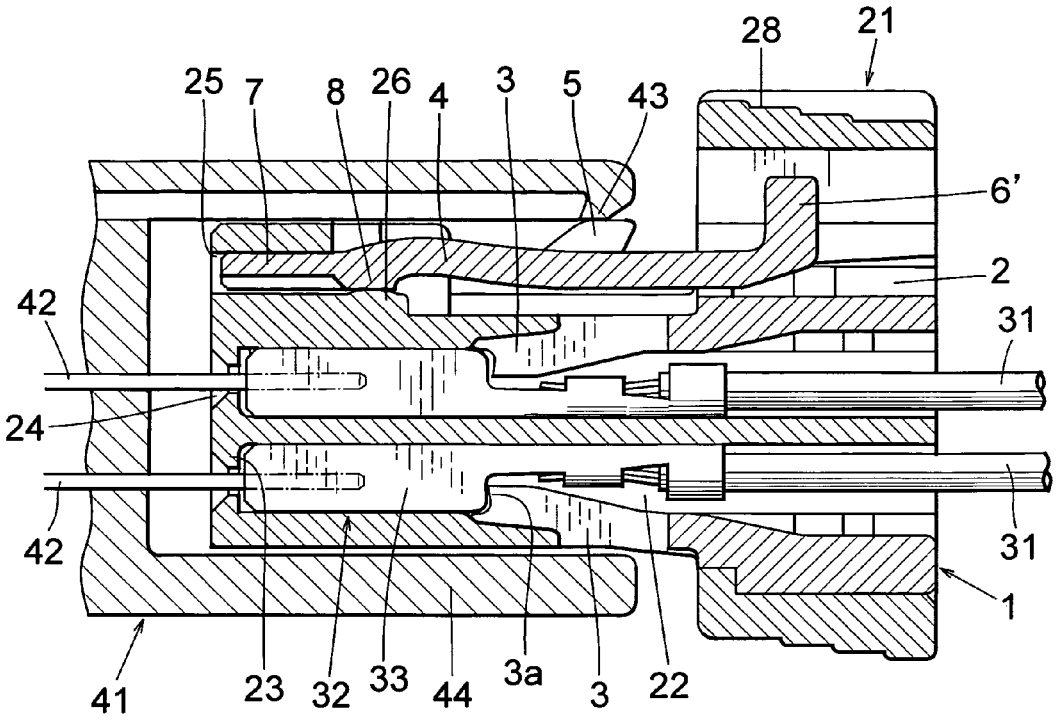
FIG. 14 is a cross sectional view showing a condition during the engagement of the main housing with the cooperating housing.

Furthermore, in the present embodiment, when the main housing 21 is engaged with the cooperating housing 41, the locking arm 4 is resiliently bent and passes under the locking claw 43 as illustrated in FIG. 14, and during this movement, the top end of the projecting portion 6' is also moved downward and is once removed from the lock-releasing push portion 28. When the engagement has been completed, the locking arm 4 is moved upward due to its resiliency and the top end of the projecting portion 6' hits the lower surface of the lock-releasing push portion 28 to produce a rather large click noise. By monitoring this click noise, a user can confirm that the engagement has been completed.

I the embodiments so far explained, the locking arm 4 of the rear holder provided on the main housing 21 is used to engage the assembly of the main housing and cooperating housing with the cooperating housing 41, but according to the invention, it is also possible to insert a rear holder into the cooperating housing and the locking arm provided on the rear holder inserted into the main holder 21 may be locked with the rear holder inserted into the cooperating housing.

In the above explained embodiments of the present invention, the locking arm 4 provided on the rear holder 1 inserted into the main housing 21 is engaged with the cooperating housing 41, the rear holder is hardly removed during the assembling, Moreover, a height of the housing can be reduced upon compared with the known connector in which the locking arm is provided directly on the main housing 21, and the connecting terminals can be accommodated into the main housing without play. Furthermore, if the rear holder 1 is not completely engaged with the main housing 21, it is no more possible to fix the locking arm with the cooperating housing 41, and thus a user can know that the incomplete insertion of the rear holder 1 into the main housing 21.

In the above embodiments, there are provided two locking arms, but according to the invention the number of the locking arms may be selected at will. For instance, when only one locking arm may be provided. In this case, it is preferable to provide the locking claw 5 immediately above the locking arm 4 to attain a symmetry.

What is claimed is:

1. An electrical connector comprising a main housing and a cooperating housing each having connecting terminals installed therein, said connecting terminals being connected to each other by engaging these housings with each other, characterized in that a rear holder is coupled with a rear portion of the main housing to prevent the connecting terminals installed therein from being removed backwardly, that a locking arm having a resiliency is provided on the rear holder such that a free end of said locking arm extends forwardly, said locking arm being locked with a locking portion of the cooperating housing and said free end of the locking arm is inserted into a part of said main housing, and that a locking claw is provided on the locking arm at a middle portion thereof such that the locking claw is engaged with the locking portion of the cooperating housing.

2. The electrical connector according to claim 1, wherein said rear holder includes locking lances for preventing the connecting terminals from being removed from the main housing.

3. The electrical connector according to claim 1, wherein said free end of the locking arm is engaged with the main housing by inserting the free end into a hole portion formed in the main housing.

4. The electrical connector according to claim 1, wherein a lock-releasing push portion is provided on said main housing, and the engagement of the main housing and cooperating housing is released by pushing said lock-releasing push portion downward to deform said locking arm such that said locking claw is moved downward.

5. The electrical connector according to claim 1, wherein the engagement of said locking claw of the locking arm and said locking portion of the cooperating housing is confirmed by inserting the rear holder with a large force.

6. The electrical connector according to claim 1, wherein a projecting portion is formed at a rear end of said locking arm and a lock-releasing push portion is formed on the main housing, and the engagement of said locking claw of the locking arm with said locking portion of the cooperating housing is confirmed by a click noise, which is generated by hitting the lock-releasing push portion of the main housing with a recovering movement of said projecting portion of the locking arm after once being moved downward.

* * * * *